US011856371B2

(12) United States Patent
Burns et al.

(10) Patent No.: US 11,856,371 B2
(45) Date of Patent: Dec. 26, 2023

(54) METHOD AND APPARATUS FOR OWN-VOICE SENSING IN A HEARING ASSISTANCE DEVICE

(71) Applicant: Starkey Laboratories, Inc., Eden Prairie, MN (US)

(72) Inventors: Thomas Howard Burns, St. Louis Park, MN (US); Lars Tuborg Jensen, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 76 days.

(21) Appl. No.: 17/247,821

(22) Filed: Dec. 23, 2020

(65) Prior Publication Data

US 2021/0120347 A1 Apr. 22, 2021

Related U.S. Application Data

(63) Continuation of application No. 15/884,850, filed on Jan. 31, 2018, now Pat. No. 10,880,657, which is a
(Continued)

(51) Int. Cl.
*H04R 25/00* (2006.01)
*H04R 1/38* (2006.01)

(52) U.S. Cl.
CPC ..... *H04R 25/60* (2013.01); *H04R 25/00* (2013.01); *H04R 25/453* (2013.01);
(Continued)

(58) Field of Classification Search
CPC ..... H04R 25/453; H04R 25/00; H04R 25/60; H04R 25/604; H04R 25/48; H04R 25/02;
(Continued)

(56) References Cited

U.S. PATENT DOCUMENTS 2,832,842 A * 4/1958 Knauert ..... H04R 11/00 381/151
4,150,262 A 4/1979 Ono
(Continued)

FOREIGN PATENT DOCUMENTS

EP 2055139 B1 12/2009
EP 1519625 B1 5/2010
(Continued)

OTHER PUBLICATIONS

"U.S. Appl. No. 13/966,058, Non Final Office Action dated Oct. 1, 2014", 14 pgs.
(Continued)

*Primary Examiner* — Harry S Hong
*Assistant Examiner* — Sabrina Diaz
(74) *Attorney, Agent, or Firm* — Schwegman Lundberg Woessner, P.A.

(57) ABSTRACT

Disclosed herein, among other things, are methods and apparatus for own-voice sensing in hearing assistance devices. One aspect of the present subject matter includes an in-the-ear (ITE) hearing assistance device adapted to process sounds, including sounds from a wearer's mouth. According to various embodiments, the device includes a hollow plastic housing adapted to be worn in the ear of the wearer and a differential sensor mounted to an interior surface of the housing in an ear canal of the wearer. The differential sensor includes inlets located within the housing and the differential sensor is configured to improve speech intelligibility of sounds from the wearer's mouth, in various embodiments.

19 Claims, 6 Drawing Sheets

Related U.S. Application Data continuation of application No. 14/720,036, filed on May 22, 2015, now Pat. No. 9,900,710, which is a continuation of application No. 13/966,058, filed on Aug. 13, 2013, now Pat. No. 9,042,586.

(60) Provisional application No. 61/682,589, filed on Aug. 13, 2012.

(52) U.S. Cl.
CPC ..... *H04R 25/604* (2013.01); *H04R 1/38* (2013.01); *H04R 25/48* (2013.01); *H04R 25/603* (2019.05); *H04R 2225/023* (2013.01); *H04R 2225/025* (2013.01); *H04R 2225/43* (2013.01); *H04R 2410/05* (2013.01); *H04R 2460/13* (2013.01)

(58) Field of Classification Search
CPC ..... H04R 25/65; H04R 25/652; H04R 1/38; H04R 2410/05; H04R 2225/023; H04R 2225/025; H04R 2225/43; H04R 2460/13
USPC ..... 381/150, 151, 380, 374, 328, 326, 322, 381/318
See application file for complete search history.

(56) References Cited

U.S. PATENT DOCUMENTS

| | | | | |
|---|---|---|---|---|
| 5,201,006 | A | 4/1993 | Weinrich | |
| 5,692,059 | A | 11/1997 | Kruger | |
| 5,812,659 | A | 9/1998 | Mauney et al. | |
| 6,754,359 | B1 | 6/2004 | Svean et al. | |
| 7,433,484 | B2 | 10/2008 | Asseily et al. | |
| 7,477,754 | B2 | 1/2009 | Rasmussen et al. | |
| 7,502,484 | B2 | 3/2009 | Ngia et al. | |
| 7,590,253 | B2 | 9/2009 | Killion | |
| 7,853,031 | B2 | 12/2010 | Hamacher | |
| 7,929,713 | B2 | 4/2011 | Victorian et al. | |
| 8,059,847 | B2 | 11/2011 | Nordahn | |
| 8,600,090 | B2 | 12/2013 | Hies et al. | |
| 9,042,586 | B2 | 5/2015 | Burns et al. | |
| 9,900,710 | B2 | 2/2018 | Burns et al. | |
| 10,880,657 | B2 | 12/2020 | Burns et al. | |
| 2005/0058313 | A1* | 3/2005 | Victorian | G10L 15/22 381/328 |
| 2006/0177083 | A1 | 8/2006 | Sjursen et al. | |
| 2007/0127757 | A2 | 6/2007 | Darbut et al. | |
| 2008/0260180 | A1* | 10/2008 | Goldstein | G10L 15/20 381/110 |
| 2009/0097683 | A1* | 4/2009 | Burns | H04R 25/02 381/315 |
| 2009/0238388 | A1 | 9/2009 | Saltykov et al. | |
| 2010/0119086 | A1 | 5/2010 | Fukuda | |
| 2010/0172523 | A1 | 7/2010 | Burns et al. | |
| 2010/0172529 | A1* | 7/2010 | Burns | H04R 25/50 381/328 |
| 2010/0246860 | A1 | 9/2010 | Rye et al. | |
| 2010/0260364 | A1 | 10/2010 | Merks | |
| 2011/0026722 | A1* | 2/2011 | Jing | G10L 25/84 381/71.1 |
| 2011/0135120 | A1 | 6/2011 | Larsen et al. | |
| 2011/0243358 | A1 | 10/2011 | Platz et al. | |
| 2014/0023217 | A1 | 1/2014 | Zhang | |
| 2014/0044294 | A1 | 2/2014 | Burns et al. | |
| 2015/0334492 | A1 | 11/2015 | Burns et al. | |
| 2018/0160238 | A1 | 6/2018 | Burns et al. | |

FOREIGN PATENT DOCUMENTS

| | | | |
|---|---|---|---|
| EP | 1744589 | B1 | 2/2011 |
| WO | WO-2008151623 | A1 | 12/2008 |
| WO | WO-2008151624 | A1 | 12/2008 |
| WO | WO-2008151638 | A1 | 12/2008 |

OTHER PUBLICATIONS

"U.S. Appl. No. 13/966,058, Notice of Allowance dated Jan. 23, 2015" 10 pgs.
"U.S. Appl. No. 13/966,058, Response filed Jan. 2, 2014 to Non Final Office Action dated Oct. 1, 2014", 9 pgs.
"U.S. Appl. No. 14/720,036, Non Final Office Action dated Apr. 6, 2017", 17 pgs.
"U.S. Appl. No. 14/720,036, Non Final Office Action dated Oct. 7, 2016", 11 pgs.
"U.S. Appl. No. 14/720,036, Notice of Allowance dated Oct. 5, 2017", 10 pgs.
"U.S. Appl. No. 14/720,036, Preliminary Amendment filed Aug. 6, 2015", 5 pgs.
"U.S. Appl. No. 14/720,036, Response filed Jan. 3, 2017 to Non Final Office Action dated Oct. 7, 2016", 6 pgs.
"U.S. Appl. No. 14/720,036, Response filed Jul. 6, 2017 to Non Final Office Action dated Apr. 6, 2017", 7 pgs.
"U.S. Appl. No. 15/884,850, Advisory Action dated Feb. 27, 2020", 3 pgs.
"U.S. Appl. No. 15/884,850, Advisory Action dated Apr. 10, 2019", 3 pgs.
"U.S. Appl. No. 15/884,850, Final Office Action dated Jan. 14, 2019", 13 pgs.
"U.S. Appl. No. 15/884,850, Final Office Action dated Dec. 11, 2019", 14 pgs.
"U.S. Appl. No. 15/884,850, Non Final Office Action dated Apr. 3, 2020", 12 pgs.
"U.S. Appl. No. 15/884,850, Non Final Office Action dated May 29, 2019", 13 pgs.
"U.S. Appl. No. 15/884,850, Non Final Office Action dated Jul. 6, 2018", 14 pgs.
"U.S. Appl. No. 15/884,850, Notice of Allowance dated Aug. 25, 2020", 10 pgs.
"U.S. Appl. No. 15/884,850, Preliminary Amendment filed Feb. 1, 2018", 5 pgs.
"U.S. Appl. No. 15/884,850, Response filed Feb. 11, 2020 to Final Office Action dated Dec. 11, 2019", 8 pgs.
"U.S. Appl. No. 15/884,850, Response filed Mar. 13, 2019 to Final Office Action dated Jan. 14, 2019", 8 pgs.
"U.S. Appl. No. 15/884,850, Response filed Jul. 2, 2020 to Non Final Office Action dated Apr. 3, 2020", 7 pgs.
"U.S. Appl. No. 15/884,850, Response filed Sep. 20, 2018 to Non Final Office Action dated Jul. 6, 2018", 8 pgs.
"U.S. Appl. No. 15/884,850, Response filed Aug. 28, 2019 to Non-Final Office Action dated May 29, 2019", 7 pgs.
"European Application Serial No. 13179859.7, Examination Notification Art. 94(3) dated Dec. 2, 2014", 4 pgs.
"European Application Serial No. 13179859.7, Extended European Search Report dated Nov. 6, 2013", 6 pgs.
"European Application Serial No. 13179859.7, Extended Search Report Response filed Aug. 7, 2014 to Extended Search Report dated Nov. 6, 2014", 19 pgs.
"European Application Serial No. 13179859.7, Invitation Pursuant to Art. 94(3)/Rule 71(1) dated Aug. 10, 2015", 3 pgs.
"European Application Serial No. 13179859.7, Response filed Aug. 26, 2015 to Invitation Pursuant to Art. 94(3)/Rule 71(1) dated Aug. 10, 2015", 3 pgs.
"Method of Measurement of Performance Characteristics of Hearing Aids Under Simulated Real-Ear Working Conditions", ANSI/ASA S3.35-2010, (2010), 49 pgs.
"Method of Measurement of Performance Characteristics of Hearing Aids Under Simulated Real-Ear Working Conditions, Table C.1.", ANSI 53.35-2010, (2010), 36-38.
Mather, G., "Perception of Sound", Foundation of Perception, Taylor & Francis, ISBN 0863778356, (2006), 9 pgs.

* cited by examiner

METHOD AND APPARATUS FOR OWN-VOICE SENSING IN A HEARING ASSISTANCE DEVICE

CLAIM OF PRIORITY

The present application is a continuation of U.S. patent application Ser. No. 15/884,850, filed Jan. 31, 2018, now issued as U.S. Pat. No. 10,880,657, which is a continuation of U.S. patent application Ser. No. 14/720,036, filed May 22, 2015, now issued as U.S. Pat. No. 9,900,710, which is a continuation of U.S. patent application Ser. No. 13/966,058, filed on Aug. 13, 2013, now issued as U.S. Pat. No. 9,042,586, which application claims the benefit under 35 U.S.C. § 119(e) of U.S. Provisional Patent Application 61/682,589, filed Aug. 13, 2012, which applications are incorporated herein by reference in their entirety.

TECHNICAL FIELD

The present subject matter relates generally to hearing assistance systems and more particularly to methods and apparatus for own-voice sensing in a hearing assistance device.

BACKGROUND

Hearing assistance devices include a variety of devices such as assistive listening devices, cochlear implants and hearing aids. Hearing aids are useful in improving the hearing and speech comprehension of people who have hearing loss by selectively amplifying certain frequencies according to the hearing loss of the subject. A hearing aid typically has three basic parts, a microphone, an amplifier and a speaker. The microphone receives sound (acoustic signal) and converts it to an electrical signal and sends it to the amplifier. The amplifier increases the power of the signal, in proportion to the hearing loss, and then sends it to the ear through the speaker. Cochlear devices may employ electrodes to transmit sound to the patient.

Undesired sounds such as noise, feedback and the user's own voice may also be amplified, which can result in decreased sound quality and benefit for the user. It is undesirable for the user to hear his or her own voice amplified. Further, if the user is using an ear mold with little or no venting, he or she will experience an occlusion effect where his or her own voice sounds hollow ("talking in a barrel"). Thirdly, if the hearing aid has a noise reduction/environment classification algorithm, the user's own voice can be wrongly detected as desired speech.

Typical hearing aid microphones have difficulties properly detecting a wearer's own voice. Problems include poor signal to (ambient) noise ratio, poor speech intelligibility, and ingress of foreign debris into the microphone. Prior solutions to this problem include: (1) the telecom industry typically uses a directional microphone system either in the housing (on the lateral side of an in-ear device) or on a boom, thereby positioning the microphones closer to the mouth. However, these directional microphones are susceptible to outside ambient noise, thereby degrading SNR and speech intelligibility, and are susceptible to foreign debris; (2) Kruger (U.S. Pat. No. 5,692,059) entitled Two active element in-the-ear microphone system combined the outputs of a dedicated airborne transducer together with a dedicated non-airborne transducer to produce a composite own-voice signal. Each transducer sensed a different frequency portion of the user's own-voice to produce the composite output. A piezoelectric accelerometer was the preferred non-airborne transducer. However, Kruger requires two different transducers: an airborne transducer and a non-airborne transducer. One transducer is dedicated to high frequency fricatives and the other is dedicated to low frequencies. A separate transducer dedicated to low frequencies, though it may give better sound quality, is superfluous for speech intelligibility in that low frequencies are not crucial for such as shown in FIG. 10; (3) Darbut (U.S. Patent Application No. 2007/0127757) entitled Behind-the-ear auditory device used an acoustic canal pad comprised of a flexible membrane and rigid base such that acoustic signals were amplified and routed to a microphone (paragraph 0130). Furthermore, the single-port (omni) microphone is coupled to this rigid base via "dampening elements whose internal prongs are offset from the external prongs, thereby isolating the microphone from vibration" (paraphrased from paragraphs 0072-3). However, Darbut employs an 'at least partially in-ear element' which consists of a standard housing with an 'acoustic pickup cushion pillow' or 'acoustic canal pad' as described in 1(c) above. It functions as a "stethoscope-like" device; specifically, it provides acoustical amplification from vibrations of the cartilaginous portion of the ear canal. Since a standard housing is used for the in-ear element, a second pad is positioned opposite the acoustic canal pad in order to snugly position the standard housing against the cartilaginous portion of the ear canal and thereby allow the stethoscope-like device to amplify properly; (4) Platz (U.S. Patent Application No. 2011/0243385) entitled System for picking-up a users voice used a standard 'one-size-fits-all' earmold to be worn at least partly in a user's ear canal together with an elongated, C-shaped retention element attached to the shell of the earmold and brought into engagement of a user's concha by manual plastic deformation by the user, thereby providing the necessary contact force between an ear microphone (i.e., a microphone oriented acoustically inwardly towards the user's ear canal and adapted for picking up the user's voice via bone conduction from the skull) and the ear canal wall. In a different embodiment, a first 'ear' microphone oriented acoustically inward towards the user's ear canal and a second 'ambient' microphone oriented outwardly towards the environment, with a sound port terminating at the outer end of the earmold, is used. Digital signal processing of the two microphone signals is performed to achieve Blind Source Separation (BSS) of the signals and thus eliminate the need of "bone-conduction microphones which would cause discomfort to the user" (paragraph 0032). However, in Platz the ear-canal microphone will not function properly without the C-shaped retention element engaged within a user's concha. In addition, this bone conduction microphone "would cause discomfort to the user" (described in paragraph 0032). As shown, the ear-canal bone conduction microphone depicted in the FIG. 3 of Platz has a separate protrusion from the earmold housing, presumably the cause of user discomfort.

Thus, there is a need in the art for an improved method and apparatus for own-voice sensing in hearing assistance devices.

SUMMARY

Disclosed herein, among other things, are methods and apparatus for own-voice sensing in hearing assistance devices. One aspect of the present subject matter includes an in-the-ear (ITE) hearing assistance device adapted to process sounds, including sounds from a wearer's mouth. According to various embodiments, the device includes a hollow plastic housing adapted to be worn in the ear of the wearer and a differential sensor mounted to an interior surface of the housing in an ear canal of the wearer. The differential sensor includes inlets located within the housing and the differential sensor is configured to improve speech intelligibility of sounds from the wearer's mouth, in various embodiments.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
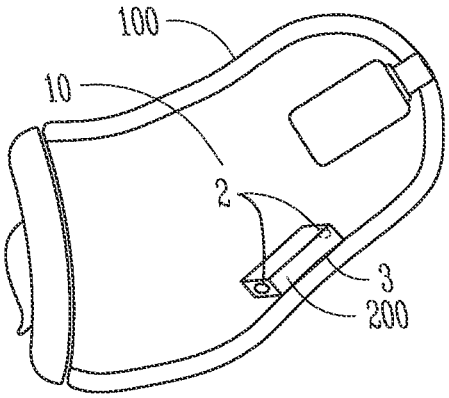
FIG. 1 illustrates an in-the-ear (ITE) hearing assistance device configured to improve speech intelligibility of sounds from the wearer's mouth, according to one embodiment of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Modern hearing assistance devices, such as hearing aids typically include a processor, such as a digital signal processor in communication with a microphone and receiver. Such designs are adapted to perform a great deal of processing on sounds received by the microphone. These designs can be highly programmable and may use inputs from remote devices, such as wired and wireless devices.

The detection of a wearer or user's own-voice for telecommunications or hearing assistance devices would benefit by improving its signal to (ambient) noise ratio, improving its speech intelligibility, and protecting it from foreign debris. For telecommunications, own-voice is typically detected with some type of boom microphone or directional microphone on the exterior housing. For hearing assistance devices, own-voice has been previously detected with one (or more) microphones in the faceplate housing. In-the-ear (ITE) hearing instruments with sensors positioned along the tip or canal of the earmold rather than the faceplate have also been used. These instruments are targeted for first-responder communication applications such as firefighters and omnidirectional microphones are typically used. The acoustical inlet of the omnidirectional microphone can be located at the tip of the earmold so as to sense the sound pressure in the air cavity of the ear canal. In this approach, the microphone is susceptible to foreign debris. Alternatively, the plastic ITE housing can contain a small elastomeric bladder with one side-wall of the bladder in contact with the ear canal skin, and the other side of the bladder connected to the microphone inlet, where the inside of the bladder contains a closed air cavity sharing air with the microphone inlet. These devices have the advantage of being acoustically isolated from the outside ambient noise, thereby protecting the microphone from foreign debris. However, they have the disadvantage of capturing an own-voice signal that is intrinsically 'boomy' and inferior for speech intelligibility. There would be an advantage, therefore, to use a sensor that can capture an own-voice signal that produces greater speech intelligibility, and is shielded from foreign debris.

Figure 10:
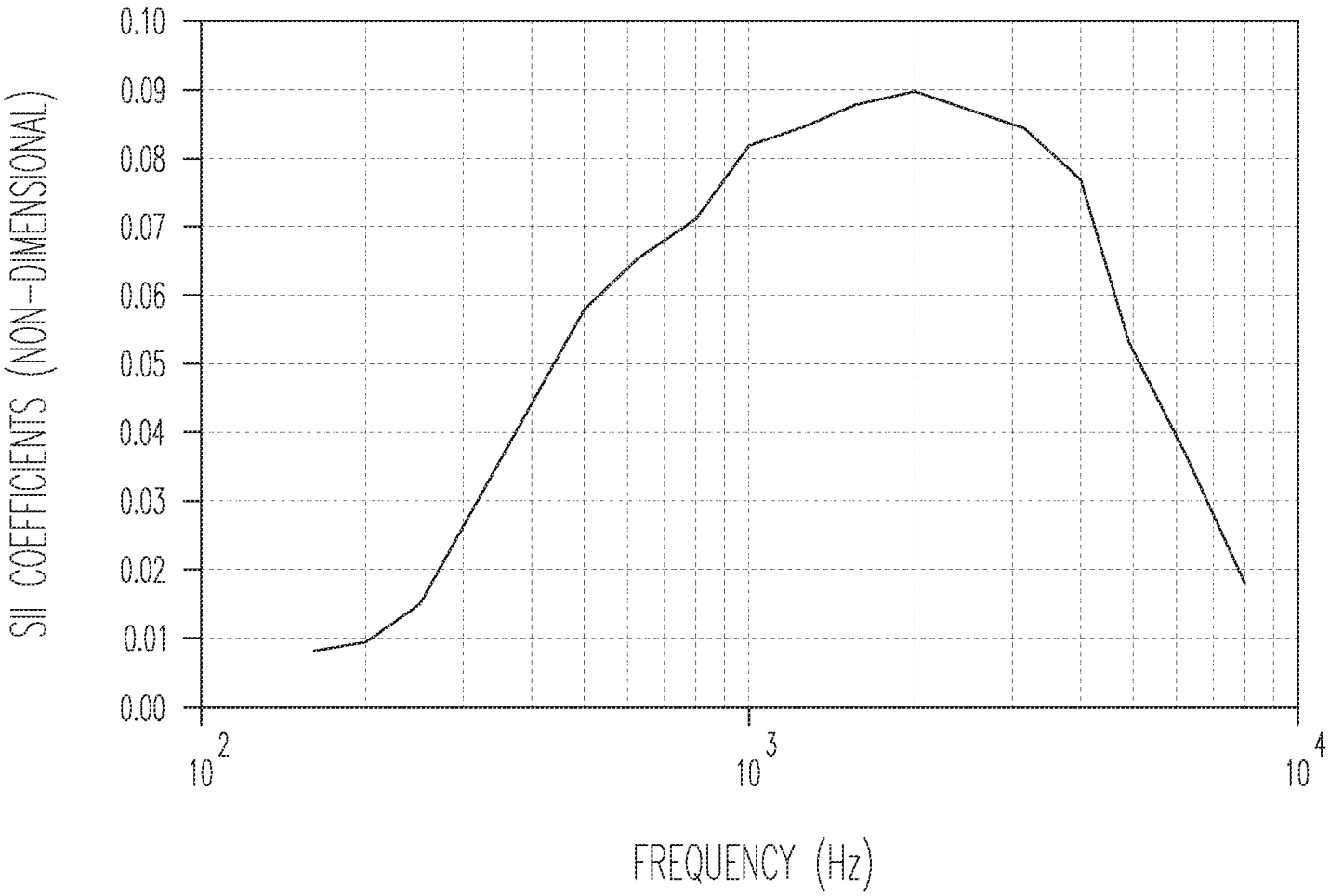
FIG. 10 is a graphical diagram illustrating frequency bands for speech intelligibility.

FIG. 10 depicts Speech Intelligibility Index (SII) coefficients. Toward that end, a pressure-differential microphone has an intrinsic response that is commensurate to the SII response and is therefore better suited for own-voice intelligibility. The important frequency bands for speech intelligibility are indicated in the illustrated SII weighted coefficients.

Therefore, the present subject matter uses a sensor with a frequency response that resembles the SII weightings. In general, omnidirectional microphones have relatively flat frequency responses whereas directional (pressure-differential) microphones have freefield responses that roll off at lower frequencies, thereby resembling the SII weightings as shown above. In addition, the internal membranes of typical pressure-differential electret microphones are not loaded with closed air cavities, and for this reason they are more sensitive to bone-conducted vibration than typical omni electret microphones. Differential microphones, therefore, are better suited for this application—not because of their directional polar response in a freefield, but because of their intrinsic frequency response and their susceptibility to bone-conducted vibration.

The present subject matter includes a differential microphone placed deep in the ear canal, mounted (directly or indirectly) to the plastic ITE housing and contained within the air cavity of the hollow plastic housing. Advantages of the present subject matter include: 1) isolation from outside ambient noise, 2) protection from foreign debris, 3) a frequency response that is similar to the SII frequency weightings, and 4) higher sensitivity to bond-conducted vibration. This last item implies that it is advantageous to mount the sensor so as to amplify bone-conducted vibrations in the frequency regions as depicted in the SII weightings. Toward that end, the sensor could be placed in an elastomeric sleeve so that its resonance frequency, i.e., the compliance of the elastomeric sleeve resonating with the mass of the sensor, enhances the overall response in the SII weighted frequency bands.

There are a number of ways the present subject matter can be implemented in an ITE hearing instrument. While the present subject matter is demonstrated using an ITE device, other types of hearing assistance devices can be used without departing from the scope of the present subject matter. FIG. 1 illustrates an in-the-ear (ITE) hearing assistance device configured to improve speech intelligibility of sounds from the wearer's mouth, according to one embodiment of the present subject matter. According to various embodiments, a differential sensor [200] is mounted rigidly [3] to the hollow plastic housing [100] of the ITE hearing instrument, such that the inlets [2] to differential sensor [200] are all located within closed air cavity [10] of ITE housing [100].

Figure 2:
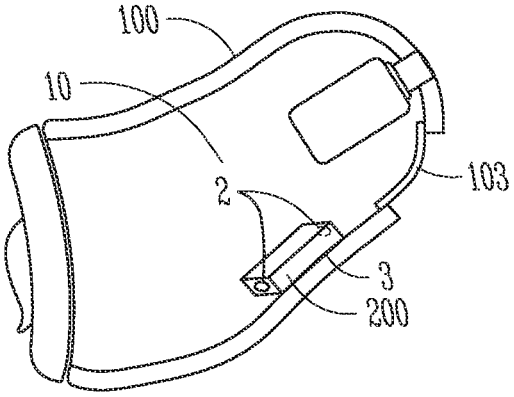
FIG. 2 illustrates an ITE hearing assistance device configured to improve speech intelligibility of sounds from the wearer's mouth, the device housing including a barrier window, according to one embodiment of the present subject matter.

FIG. 2 illustrates an ITE hearing assistance device configured to improve speech intelligibility of sounds from the wearer's mouth, the device housing including a barrier window, according to one embodiment of the present subject matter. The embodiment in FIG. 2 is similar to the embodiment in FIG. 1 except that internal air cavity [10] of hollow plastic housing [100] has a relatively small barrier window [103] positioned at the eartip, proximate to the medial ear canal air cavity. Barrier window [103] could also be made of the same material as the housing, or of some other plastic, except that it is thinner than plastic housing [100] in various embodiments. Its dimensions and material properties can be engineered to resonate and enhance the differential sensor [200] output in the SII weighted frequency bands. Similarly, the dimensions and material properties of sensor pad [3] also can be engineered to resonate mechanically and enhance the differential sensor [200] output in the SII weighted frequency bands, in various embodiments.

Figure 3:
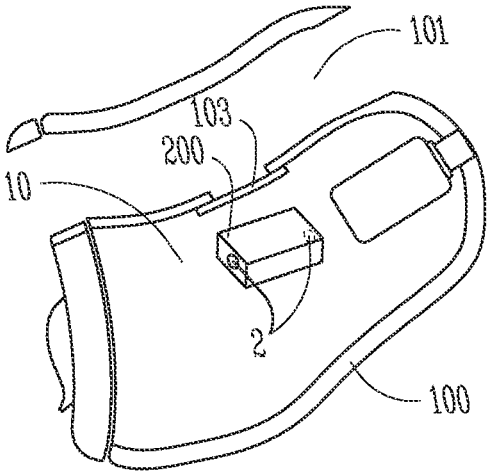
FIG. 3 illustrates an ITE hearing assistance device including a vented housing and a barrier window, the device configured to improve speech intelligibility of sounds from the wearer's mouth, according to one embodiment of the present subject matter.

FIG. 3 illustrates an ITE hearing assistance device including a vented housing and a barrier window, the device configured to improve speech intelligibility of sounds from the wearer's mouth, according to one embodiment of the present subject matter. The embodiment in FIG. 3 is similar to the embodiment of FIG. 2, except that ITE housing [100] is vented [101] and the small barrier window [103] is located on the wall of the vent [101] such that the inlets [2] of differential sensor [200] are still positioned within the closed air cavity [10] of ITE housing [100].

Figure 4:
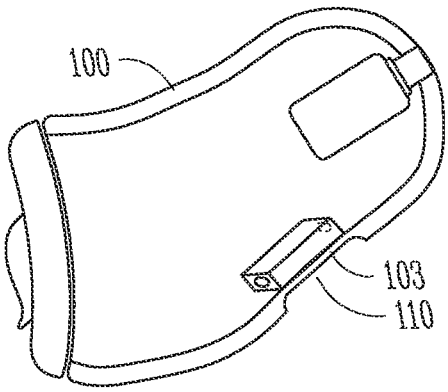
FIG. 4 illustrates an ITE hearing assistance device including a thin section of housing and a barrier window, the device configured to improve speech intelligibility of sounds from the wearer's mouth, according to one embodiment of the present subject matter.

FIG. 4 illustrates an ITE hearing assistance device including a thin section of housing and a barrier window, the device configured to improve speech intelligibility of sounds from the wearer's mouth, according to one embodiment of the present subject matter. The embodiment in FIG. 4 is similar to the embodiments of FIGS. 2-3, except that the small window [103] is located on the side of ITE housing [100] proximate to the ear canal skin. In various embodiments, a small air cavity [110] is located between the small window [103], alternatively a thin section of the shell itself, and the skin, which is to say, small window [103] is not flush to the skin.

Figure 5:
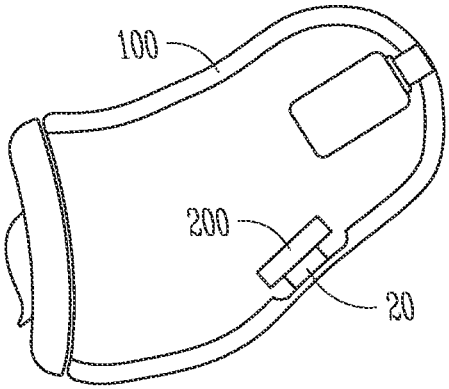
FIG. 5 illustrates an ITE hearing assistance device including a differential sensor mounted to an elastomeric suspension, the device configured to improve speech intelligibility of sounds from the wearer's mouth, according to one embodiment of the present subject matter.

FIG. 5 illustrates an ITE hearing assistance device including a differential sensor mounted to an elastomeric suspension, the device configured to improve speech intelligibility of sounds from the wearer's mouth, according to one embodiment of the present subject matter. The embodiment in FIG. 5 is similar to the previous embodiments except that differential sensor [200] is not rigidly mounted to plastic housing [100] but rather is mounted to an elastomeric suspension [20] whose resonance frequency is engineered to enhance the differential sensor [200] output in the SII weighted frequency bands, in various embodiments.

Figure 6:
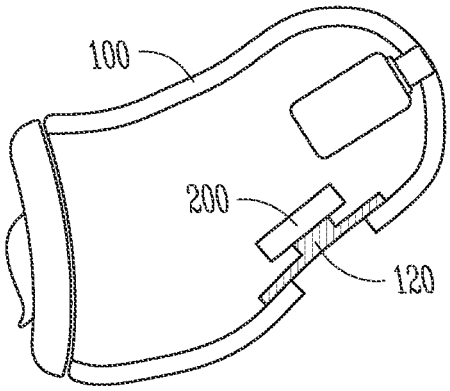
FIG. 6 illustrates an ITE hearing assistance device including a differential sensor integrated into a window barrier, the device configured to improve speech intelligibility of sounds from the wearer's mouth, according to one embodiment of the present subject matter.

FIG. 6 illustrates an ITE hearing assistance device including a differential sensor integrated into a window barrier, the device configured to improve speech intelligibility of sounds from the wearer's mouth, according to one embodiment of the present subject matter. The embodiment in FIG. 6 is similar to the previous embodiments except that sensor [200] is integrated onto window barrier [120], such that all inlets of sensor [200] remain within hollow plastic housing [100]. Integrated barrier [120] and sensor [200] have a resonance frequency that is engineered to enhance the sensor output in the SII weighted frequency bands, in various embodiments.

Figure 7:
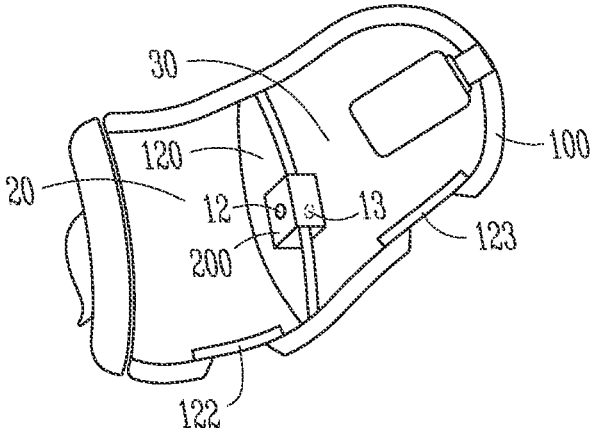
FIG. 7 illustrates an ITE hearing assistance device including a housing divided into multiple separate air cavities, the device configured to improve speech intelligibility of sounds from the wearer's mouth, according to one embodiment of the present subject matter.

FIG. 7 illustrates an ITE hearing assistance device including a housing divided into multiple separate air cavities, the device configured to improve speech intelligibility of sounds from the wearer's mouth, according to one embodiment of the present subject matter. In this embodiment, the ITE housing [100] is divided into two separate air cavities [20] and [30] by barrier [120]. Differential sensor [200] is integrated into barrier [120] such that acoustical inlet [12] is located within air cavity [20] having a small window barrier [122] and acoustical inlet [13] is located within air cavity [30] having another small window barrier [123], in various embodiments. Alternatively, window barriers [122] and [123] could be located on the wall of a vent, as shown in FIG. 3. In various embodiments, barrier [120] can be elastomeric or plastic, and engineered to resonate and enhance the sensor output in the SII weighted frequency bands.

Figure 8:
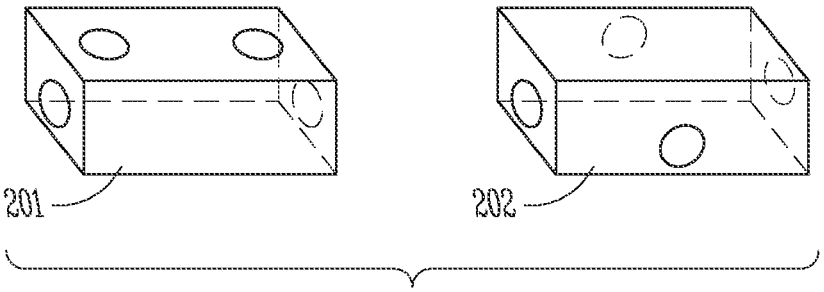
FIG. 8 illustrates second-order pressure differential sensor to be used in an ITE hearing assistance device, the device configured to improve speech intelligibility of sounds from the wearer's mouth, according to one embodiment of the present subject matter.

FIG. 8 illustrates second-order pressure differential sensor to be used in an ITE hearing assistance device, the device configured to improve speech intelligibility of sounds from the wearer's mouth, according to one embodiment of the present subject matter. FIG. 8 depicts a single, second-order pressure differential sensor which is used in any and all of the above embodiments instead of a first-order pressure differential sensor, thereby increasing its sensitivity to vibration. For electret microphones, this implies that four inlets are used instead of two. In various embodiments, the four inlets can either be arranged linearly, as with a linear quadrupole [201], or as orthogonal pairs [202], as with a tesseral quadrupole.

Figure 9:
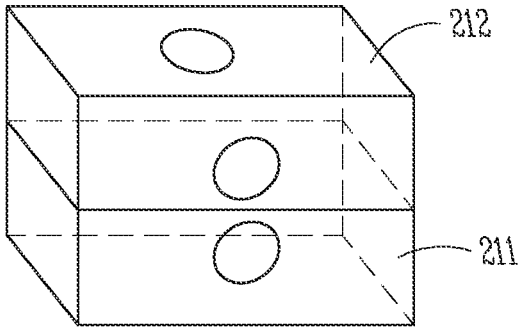
FIG. 9 illustrates a combination sensor to be used in an ITE hearing assistance device, the device configured to improve speech intelligibility of sounds from the wearer's mouth, according to one embodiment of the present subject matter.

FIG. 9 illustrates a combination sensor to be used in an ITE hearing assistance device, the device configured to improve speech intelligibility of sounds from the wearer's mouth, according to one embodiment of the present subject matter. In the embodiment of FIG. 9, the outputs of both an omni [211] and differential [212] sensor are combined to give a system output signal that has extended low frequencies as compared to the output of a differential sensor alone. The signals are combined not necessarily to improve speech intelligibility, but to produce sound quality of own-voice that is richer and fuller. This combination sensor, which can be piggy-backed as shown or conjoined side-by-side, could be used in all of the embodiments shown previously.

The present subject matter provides ways to arrange and mount a sensor within the housing of an ITE housing instrument so as to improve the speech intelligibility of the sensor's output signal. Unique aspects of the present subject matter include, but are not limited to: (1) a single, passive, pressure-differential electret microphone can be used for enhanced speech intelligibility; (2) the passive, pressure-differential microphone can have either a $1^{st}$- or $2^{nd}$-order freefield response; (3) the mounting suspension stiffness is engineered to resonate with the mass of the differential microphone so as to amplify and enhance the sensor's bone-conduction response in the SII weighted frequency bands. Engineering includes the choice of elastomer and its geometrical dimensions, particularly its thickness; (4) the tension and effective mass of the elastomeric window barrier, integrated into the wall of the plastic housing, is engineered to resonate with the stiffness of the air cavity within the plastic housing so as to amplify and enhance the sensor's response in the SII weighted frequency bands. Engineering includes the choice of elastomer and its geometrical dimensions, particularly its thickness; and (5) a combination module containing both an omni and pressure-differential sensor can be used to extend low frequencies for a sound quality of own-voice that is fuller.

Advantages of the present subject matter over previous solutions include, but are not limited to: (1) a sensor comprising a single electret microphone consumes less electrical power than multi-microphone approaches; (2) a sensor comprising a single, pressure-differential electret microphone is more sensitive to bone-conducted vibration as compared to an omni electret microphone; (3) a sensor comprising a single, piezoceramic microphone is more sensitive to bone-conducted vibration as compared to an omni electret microphone; (4) the mounting of the sensor does not require any specialty bladders or pillows that protrude out of the shell, thereby causing potential discomfort to the user; (5) the sensor is located inside of the ITE earmold thereby protecting it from foreign debris; and (6) the output of a second omni sensor can be combined with the output of the differential sensor to extend low frequencies and provide a fuller quality of sound to own-voice.

Additional embodiments of the present subject matter include, but are not limited to: (1) using a piezoceramic microphone instead of an electret microphone. Piezoceramic microphones were used in hearing instruments briefly in the early 1970's, and are intrinsically more sensitive to (bone conduction) vibration than typical electrets. The piezoceramic microphone can either be omni or differential; (2) using a silicon MEMS microphone instead of an electret microphone. MEMS microphones are used considerably in today's telecom instruments, and may be more sensitive to (bone conduction) vibration than typical electrets. The MEMS microphone can either be omni or differential; (3) in each above embodiment, the output signal of a separate faceplate microphone could be used in a digital signal processing method to enhance the quality of the own-voice sensor signal. In one example such as quiet ambient noise environments, the faceplate microphone output signal could be combined with the own-voice sensor signal to produce an enhanced system output signal. In another example, the faceplate microphone output signal could be cross-correlated with the own-voice sensor signal to determine when the user is actually talking, thereby gating the transmission of the own-voice signal; (4) in each above embodiment having a pressure-differential sensor whose output signal is inherently deficient of low frequency energy, a DSP scheme using psychoacoustic bass-enhancement algorithms can be used to artificially extend and enhance the perception of the low-frequency harmonics (60 to 250 Hz) of the speech signal, thereby providing a fuller, richer sound quality of own-voice.

Benefits of the present subject matter, including those based on choice of sensor and mounting system, include, but are not limited to: (1) provides higher speech intelligibility; (2) provides protection against foreign debris, (3) uses a pressure-differential sensor that is more susceptible to bone-conducted vibration, (4) uses a pressure-differential sensor that enhances the response in the critical frequency regions for speech intelligibility, (5) uses a suspension system whose resonance frequency is tuned to enhance the response in the critical frequency regions for speech intelligibility, (6) uses a secondary omnidirectional sensor to enhance the fullness of sound quality for own-voice, (7) uses a piezoceramic sensor that is more susceptible to bone-conducted vibration, (8) uses a differential sensor and a DSP algorithm to extend and enhance the low frequency harmonics of the speech signal, thereby providing a fuller, richer sound quality of own voice, (9) uses a faceplate microphone together with a DSP algorithm to gate the transmission of the own-voice signal, uses a faceplate microphone together with a DSP algorithm to determine quiet ambient noise environments and enhance the quality of own-voice by combining the faceplate microphone output with the own-voice sensor output.

It is understood that variations in communications standards, protocols, and combinations of components may be employed without departing from the scope of the present subject matter. Hearing assistance devices typically include an enclosure or housing, a microphone, hearing assistance device electronics including processing electronics, and a speaker or receiver. Processing electronics include a controller or processor, such as a digital signal processor (DSP), in various embodiments. Other types of processors may be used without departing from the scope of this disclosure. It is understood that in various embodiments the microphone is optional. It is understood that in various embodiments the receiver is optional. Thus, the examples set forth herein are intended to be demonstrative and not a limiting or exhaustive depiction of variations.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevet, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device, comprising:

a housing adapted to be worn in an ear of a wearer;

a microphone mounted on or in the housing or a faceplate of the housing;

an own-voice sensor within the housing, the own-voice sensor configured to amplify an input signal in a selected frequency region to detect an own-voice signal from the wearer;

a processor within the housing, the processor configured to control transmission of the own-voice signal by correlating an output of the microphone with an own-voice sensor output; and a resonator positioned between the own-voice sensor and the housing, the resonator and at least a portion of the housing configured to resonate in the selected frequency region to enhance the own-voice sensor output.

2. The hearing assistance device of claim 1, wherein the own-voice sensor includes a microelectromechanical system (MEMS) sensor.

3. The hearing assistance device of claim 1, wherein the own-voice sensor includes a differential sensor.

4. The hearing assistance device of claim 1, wherein the own-voice sensor includes a piezoceramic sensor.

5. The hearing assistance device of claim 1, wherein the own-voice sensor is configured to amplify bone-conducted vibrations.

6. The hearing assistance device of claim 1, wherein the hearing assistance device includes a hearing aid.

7. The hearing assistance device of claim 6, wherein the hearing aid includes an in-the-ear (ITE) hearing aid, an in-the-canal (ITC) hearing aid, a receiver-in-canal (RIC) hearing aid, or a completely-in-the-canal (CIC) hearing aid.

8. The hearing assistance device of claim 1, wherein the processor is configured to cross-correlate the output of the microphone with an output signal from the own-voice sensor to determine when the wearer is talking to gate transmission of the own-voice signal.

9. The hearing assistance device of claim 1, wherein the processor is configured to use a first digital signal processor (DSP) algorithm with the output of the microphone to gate transmission of the own-voice signal, and the processor is configured to use a second DSP algorithm with the output of the microphone to determine quiet ambient noise environments and to combine the output of the microphone with an output signal from the own-voice sensor to enhance own-voice signal quality.

10. A method, comprising:

detecting an own-voice signal using an own-voice sensor within a hearing assistance device housing configured to be worn in an ear of a wearer, wherein the own-voice sensor is configured to amplify an input signal in a selected frequency region to detect the own-voice signal from the wearer; and controlling transmission of the own-voice signal by correlating an output from a microphone mounted on or in the housing or a faceplate of the housing with an own-voice sensor output, wherein the hearing assistance device includes a resonator positioned between the own-voice sensor and the housing, the resonator and at least a portion of the housing configured to resonate in the selected frequency region to enhance the own-voice sensor output.

11. The method of claim 10, further comprising combining the output from the microphone with an output from the own-voice sensor to produce an enhanced output signal.

12. The method of claim 10, further comprising cross-correlating the output from the microphone with an output from the own-voice sensor to assist in determining when the wearer is talking.

13. The method of claim 10, further comprising resonating and enhancing output of the own-voice sensor in selected frequency regions using a barrier window.

14. The method of claim 13, wherein the barrier window includes a plastic material that has a thickness less than a thickness of the housing.

15. The method of claim 10, wherein the own-voice sensor is mounted to an interior surface of the housing, the method further including resonating and enhancing output of the own-voice sensor in selected frequency regions based on a specified mounting suspension stiffness.

16. The method of claim 10, wherein the own-voice sensor is configured to be placed in an elastomeric sleeve; and the method further comprises resonating and enhancing output of the own-voice sensor in selected frequency regions using the elastomeric sleeve.

17. The method of claim 10, wherein the own-voice sensor is enclosed in an enclosure located within the housing, the enclosure mounted indirectly to an interior surface of the housing using a mechanical resonator, and the method further comprises resonating and enhancing output of the own-voice sensor in selected frequency regions using the mechanical resonator.

18. A hearing assistance device, comprising:

a housing configured to be worn in an ear of a wearer;

a microphone in the housing;

an own-voice sensor in the housing, the own-voice sensor configured to amplify an input signal in a selected frequency region to detect an own-voice signal from the wearer;

a processor in the housing, the processor configured to cross-correlate an output of the microphone with an output signal from the own-voice sensor to determine when the wearer is talking to control transmission of the own-voice signal; and a resonator in or on the housing, the resonator and at least a portion of the housing configured to resonate in the selected frequency region to enhance the own-voice sensor output.

19. The hearing assistance device of claim 18, wherein the processor is configured to combine the output of the microphone with the output signal from the own-voice sensor to enhance own-voice signal quality.

* * * * *